US011338967B2

(12) United States Patent
Bottger

(10) Patent No.: US 11,338,967 B2
(45) Date of Patent: May 24, 2022

(54) CONTAINER WITH A HERMETIC CLOSURE

(71) Applicant: Bettina Bottger, Estoril (PT)

(72) Inventor: Bettina Bottger, Estoril (PT)

( * ) Notice: Subject to any disclaimer, the term of this patent is extended or adjusted under 35 U.S.C. 154(b) by 108 days.

(21) Appl. No.: 16/536,556

(22) Filed: Aug. 9, 2019

(65) Prior Publication Data

US 2020/0047956 A1 Feb. 13, 2020

(30) Foreign Application Priority Data

Aug. 9, 2018 (ES) ..... ES201831260

(51) Int. Cl.
*B65D 45/06* (2006.01)
*B65D 45/30* (2006.01)
*B65D 53/02* (2006.01)

(52) U.S. Cl.
CPC ..... *B65D 45/06* (2013.01); *B65D 45/305* (2013.01); *B65D 53/02* (2013.01); *B65D 2543/00296* (2013.01); *B65D 2543/00305* (2013.01)

(58) Field of Classification Search
CPC ..... B65D 45/06; B65D 45/30; B65D 45/32; B65D 45/322; B65D 45/305; B65D 53/02
See application file for complete search history.

(56) References Cited

U.S. PATENT DOCUMENTS 588,009 A * 8/1897 Quillfeldt ..... B65D 39/0082 215/241

FOREIGN PATENT DOCUMENTS

| | | |
|---|---|---|
| DE | 3149558 C1 | 6/1983 |
| EP | 3205596 A1 | 8/2017 |
| GB | 143520 | 11/1920 |

* cited by examiner

*Primary Examiner* — Jeffrey R Allen
(74) *Attorney, Agent, or Firm* — Eugenio J. Torres-Oyola; Victor M. Rodriguez-Reyes; Rafael Rodriguez-Muriel

(57) ABSTRACT

The container with a hermetic closure has a receptacle having a receptacle opening surrounded by an annular mouth surface, a lid having a front side and a back side intended for being oriented towards the outside and the inside of the receptacle, respectively, a sealing ring arranged between the annular mouth surface of the receptacle and an annular perimetral flange of the lid, and a closure mechanism formed by a shaped metal wire defining a first region coupleable to the lid, a second region being under elastic stress in a closed position and a third region coupleable to the receptacle. The front side of the lid has at least two opposite supporting points in an area coinciding with or adjacent to the annular flange, and the first region of the closure mechanism is configured for being supported, in a closed position, on said at least two opposite supporting points.

19 Claims, 7 Drawing Sheets

CONTAINER WITH A HERMETIC CLOSURE

TECHNICAL FIELD

The present invention relates to the field of containers with a hermetic closure, the containers being of the type including a receptacle, a lid, a sealing ring and a closure mechanism formed by a shaped metal wire.

STATE OF THE ART

Containers provided with a lid held against the mouth of a receptacle by means of a closure mechanism formed by a shaped metal wire, with a sealing ring being sandwiched between the lid and the mouth of the receptacle to assure leak-tight closure, have been known for over a hundred years.

Closure mechanisms can be found in many designs, with a well-known one being a mechanism similar, for example, to that described in document GB143520A which is provided with an arcuate metal wire that goes above the lid and presses it towards the receptacle at the center thereof, the lid having a dome shape with a rib in the center thereof on which said metal wire is supported. Lever mechanisms on opposite sides of the receptacle, also formed by means of a metal wire, are articulated to that arcuate metal wire allowing pressure to be applied on or removed from said arcuate wire.

However, this solution presses the central part of the lid in an area away from the perimeter where sealing takes place, so pressure is not exerted at the point where its effect may be the most beneficial to assure proper sealing, whereby an irregular or poor sealing may take place. To prevent this defect, it is often decided to apply a large amount pressure in that central part, thereby assuring that sufficient pressure exists on the entire perimeter to assure sealing which, however, requires that central part of the lid to have a significant thickness and a convex shape to enable withstanding that stress and therefore results in a very heavy lid that is therefore cumbersome, expensive to manufacture, and has a significant environmental impact. Furthermore, this solution prevents stacking the containers. Additionally, the convex lid with a supporting point in the center thereof means that the metal wire must also be curved to enable being superimposed on said lid, causing an increase in the length of said metal wire and making the supporting point of the wire with the lid to be arranged very far away from the pressure-applying lever mechanism. Both the length of the metal wire and the distance existing between the lever mechanism and the supporting point are two factors that negatively affect stresses said wire withstands. Since said metal wire is subjected not only to a pulling force but also to a bending force, the increase in the length thereof and the distance between its supports causes greater stresses therein, which means that metal wire thicknesses sized for withstanding said stresses must be used.

With the length of the metal wire and the distance between supporting points thereof being increased by the use of a convex lid with a central support, it is required to use a stronger metal wire that is therefore more expensive to manufacture with respect to other solutions which allow reducing the total length of the wire and placing the supporting points of the wire on the lid closer to the lever mechanisms at the sides of the receptacle.

There is also a solution in which the lid is surrounded by a metal ring which at one side thereof is articulated with respect to another metal ring fixed around the neck of the receptacle, which allows opening and closing the lid about said articulation. At an end diametrically opposite the articulation, both metal rings are attached to one another with a lever mechanism which allows closing the lid by applying pressure to pull the lid against the receptacle. This solution allows providing a flat lid, but pressure is applied in an asymmetrical manner only on one side of the lid, so the sealing is irregular and a large amount of pressure must be applied to assure proper sealing, a very thick and heavy lid being needed to withstand and distribute that pressure, said lid therefore being expensive to manufacture, cumbersome, and having a significant environmental impact.

Other solutions are also known in which the wire is attached in an articulated manner on two opposite sides of the edge of the lid, as described in document EP3205596A1, for example, however this solution also requires a lid with a very thick edge to enable including that articulated attachment, which likewise results in a very heavy lid that is expensive to manufacture and has a high environmental impact. Furthermore, in this solution pressure is applied on the sides of the lid where the ends of the metal wire forming the closure mechanism are laterally inserted into holes parallel to the sealing ring, so when pressure is applied to perform closing, said ends of the wire will bend, pressing into the irregular-shaped hole, which would not occur if pressure was applied downwardly on the front side of the lid. In this document, this problem is solved by increasing the pressure required to assure that sufficient pressure is applied on the entire sealing ring, requiring a strong lid with a significant thickness.

Solutions in which the metal wire of the closure mechanism goes through the lid through a hole are also known, however this solution again requires a lid with a significant thickness, and therefore, a significant weight.

There are also other solutions using multiple metal clamps or fasteners distributed around the lid, as the one described in document DE3149558, for example, with each fastener pressing the lid against the receptacle.

However, this solution does not allow a simultaneous closing and opening of the container as a whole, and the quality of the sealing will depend on the number and position in which said clamps or fasteners are placed. Furthermore, it cannot be assured that all the clamps or fasteners exert the same pressure on the lid, due to the fact that each fastener may have been used a different number of times or subjected to different stresses when being placed or removed, and therefore undergone different fatigue or deformation processes, or due in addition to the fact that the different clamps or fasteners correspond to different manufacturing batches. Therefore, the attainment of a uniform hermetic closure on the entire perimeter of the lid cannot be assured, which means that an overpressure must be exerted to assure that all the points of the perimeter of the lid are sufficiently closed.

Furthermore, this solution easily leads to the loss of said clamps or fasteners or to one or more of the clamps or fasteners being released due to an accidental, inconsequential blow, with the hermetic sealing of the container being accidentally released.

None of the known solutions provides a hermetic closure which assures pressure in the entire contact area between the lid and the mouth of the receptacle, assuring a sufficient hermetic sealing, and which can be opened or closed with a single action and at the same time allows using a lightweight lid.

DISCLOSURE OF THE INVENTION

The present invention relates to a container with a hermetic closure including:

a receptacle defining a mouth including a receptacle opening and an annular mouth surface surrounding said receptacle opening;

a lid with a front side and a back side intended for being oriented towards the outside and the inside of the receptacle, respectively, said lid including an annular perimetral flange which, in a closed position, is superimposed on the annular mouth surface of the mouth of the receptacle;

a sealing ring arranged and held between the annular mouth surface of the mouth of the receptacle and the annular perimetral flange of the lid;

a closure mechanism movable between a closed position, in which the closure mechanism holds the lid against the mouth of the receptacle, and an open position, in which the closure mechanism releases the lid, allowing the opening thereof, the closure mechanism being formed by a shaped metal wire defining:

a first region configured for being superimposed, when in the open position, on a part of the front side of the lid;

a second region formed by two symmetrical portions arranged on diametrically opposite sides of the mouth of the receptacle, each connected to a different end of the first region and configured for being under elastic stress, when in the closed position, attracting the first region to the mouth of the receptacle;

at least a third region configured for being coupled, when in the closed position, to a portion of the receptacle adjacent to its mouth and connected to the symmetrical portions of the second region.

The receptacle and/or the lid can be made of glass or ceramic, although alternatively the use of plastic is also contemplated.

The closure mechanism is therefore formed by a shaped metal wire defining three regions, a first region arranged above the closure lid, a second region which, in the closed position, is under elastic stress, moving the first region closer to the mouth, pressing the lid against said mouth, and a third region connected to the receptacle and serving as a supporting point with respect to the second region to produce that elastic stress.

It is understood that the closure mechanism is a unitary mechanism, i.e., its parts are connected to one another such that movement between the closed and open positions occurs together in a simultaneous manner. Any closure mechanism formed by parts that can be released independently of one another is excluded from the definition.

The second region of the metal wire of the current proposal is formed by two opposite portions with the same features, one on each side of the mouth of the receptacle, thereby producing elastic stress of the same force at the two ends of the first region of the wire, so the force applied by the first region on the lid is as uniform as possible.

The present invention proposes, in a manner not known in the state of the art, for the lid to include at its front side at least two opposite supporting points in an area coinciding with or adjacent to the annular flange, and for the first region of the closure mechanism to be configured for being supported, in the closed position, on said at least two opposite supporting points.

It will be understood that the supporting points at the front side of the lid will be vertically accessible supporting points perpendicular to the surface defined by the annular mouth surface.

By pressing the closure mechanism on two opposite points of the front side of the lid, a more uniform pressure is exerted on said lid, which allows assuring an improved hermetic closure by applying less pressure. By reducing the pressure required to assure a hermetic closure, the opening and closing of the container is made easier, while at the same time allowing the size and thickness of the elements, particularly of the lid, to be reduced, thereby achieving a container that is much more lightweight, cost-effective, and ecological as less material is required for its manufacture.

The first region of the closure mechanism may be formed defining a bend coinciding with said at least two supporting points in the closed position. In other words, the first region may not be straight but rather may include those bends that will be configured to coincide with the supporting points. This allows better controlling the point at which the first region applies pressure on the lid.

In such a case, said at least two opposite supporting points may be pits defined on the front side of the lid in which the ends of said bends may be fitted.

According to another alternative embodiment, said at least two opposite supporting points are located on an annular closure rib protruding from the front side of the lid. In other words, the lid includes a rib having a ring shape, a circular shape, or another shape on which there are located the supporting points which must be arranged on or adjacent to the annular flange, so said annular rib will also be located in those same areas.

According to one embodiment, the annular closure rib has a smooth surface with a plurality of supporting points for receiving the first region of the closure mechanism.

Alternatively, the annular closure rib will include notches at certain intervals, each notch corresponding to a supporting point for receiving the first region of the closure mechanism in said notches.

According to a proposed embodiment, the annular perimetral flange has a thickness equal to or less than 5 mm. This thickness of the flange will practically be the only visible thickness of the lid when it is in the closed position, so a lightweight image of the lid will be obtained as a result of this feature.

With the annular closure rib located on the flange, the force exerted on the annular closure rib is transmitted, compressing the annular flange, directly to the mouth of the receptacle, and therefore subjecting the lid to very little stress.

This feature allows reducing the stresses that must be withstood by the lid, or at least the central areas of said lid, therefore allowing the use of a lid having a little thickness, and therefore being very lightweight and cost-effective.

Preferably, the central portion of the lid, in the area which is devoid of annular centering rib, will have a thickness equal to or less than 5 mm.

The lid may include at its back side an annular centering rib of a smaller diameter than the mouth of the receptacle, provided for being inserted into said mouth when the lid is in the closed position, thereby assuring a proper positioning of the lid with respect to the mouth of the receptacle.

Preferably, the lid will be a pressing lid with the annular centering rib having an annular perimetral groove in which the sealing ring is fitted, thereby the sealing ring is attached to the lid even when it is separated from the receptacle.

According to one embodiment, the annular closure rib has a smooth supporting surface for receiving the first region of the closure mechanism.

Alternatively, it is proposed for the annular closure rib to have a supporting surface with notches at regular intervals for receiving the first region of the closure mechanism in said notches. In such a case, the annular closure rib will preferably have, between two contiguous notches, an inclined supporting surface defining a slope towards said notch for leading the first region of the closure mechanism to the closest notch.

If the notches have a depth equal to or greater than the thickness of the metal wire, the closure mechanism in the closed position will not protrude from the protruding annular closure rib, which can allow stacking containers on top of one another.

In relation to the closure mechanism, according to an embodiment of the invention it is proposed for the first region to be formed by a first wire and the two symmetrical portions forming the second region to be formed by a second metal wire independent from the first wire, each of the two opposite ends of the first wire being attached in an articulated manner to the second wire, and the second metal wire being attached to the receptacle by means of two symmetrical articulated attachments defined on opposite sides of the mouth by the third region of the closure mechanism. In other words, a first wire, integrating the first region, has its ends articulated with respect to a second wire which integrates the two symmetrical portions of the second region of the closure mechanism, said second wire being articulated with respect to the receptacle through the third region of the closure mechanism.

Said third region of the closure mechanism can be defined by the two ends of the second metal wire inserted into respective housings, which can be housings defined in the wall of the receptacle or housings defined in a fixed collar around the receptacle in a position adjacent to its mouth.

It is proposed for the segment of the second metal wire connecting the two symmetrical portions of the second region to form a lever arm which simultaneously actuates both symmetrical portions to arrange the closure mechanism in the open position or closed position.

In other words, the movement of said lever arm will cause the rotation of the second wire around the articulation attached to the receptacle, causing the movement of the second region and also of the points of articulation between the first region and the second region, thereby applying pressure on the lid or releasing same.

According to an alternative embodiment, the first region, the second region, and the third region will be formed with one and the same metal wire, the third region being complementary to an annular notch defined around the mouth of the receptacle. By anchoring said third region in the mentioned notch of the receptacle, the second region will be subjected to elastic stress and the first region will be superimposed on the annular closure rib of the lid, pressing it against the mouth of the receptacle.

Preferably, the second region is shaped in the form of a spring to maximize the elastic stress produced by the second region.

Preferably, the sealing ring is made of an injection molded material, preferably plastics or other materials of non-natural origin, or thermoplastic rubber, for example, and has a thickness equal to or less than 2.5 mm.

Materials of natural origin other than plastics are conventionally employed for this use, but materials of this type cannot be injection molded but rather must be obtained by means of cutting processes which produce elastomeric rings with a considerable thickness, typically greater than 3 mm. Furthermore, natural materials of this type require a large amount of pressure to perform compression that is necessary for assuring proper sealing.

The proposed elastomeric seal, however, can be molded without requiring other cutting operations, can have a smaller thickness, and can produce a better sealing using a smaller amount of compressive force.

A preferred feature is that the diameter of the lid is greater than the distance separating the annular closure rib from the third region of the closure mechanism, with said closure mechanism and said lid being in the closed position. This means that the present invention is directed primarily at wide-mouth containers and not at narrow-mouth bottles.

If the lid were to remain attached to the closure mechanism even in the open position, like in many known solutions, the dimensions of wide-mouth containers would not allow moving the lid away from the mouth enough so as to leave the mouth completely unobstructed. The proposed solution allows releasing the closure lid with respect to the closure mechanism, the closure lid being freed from said closure mechanism.

It is also proposed for the container to include on the upper surface of its base at least one notch configured for coinciding, when said container is stacked on the lid of an identical lower container, with at least portions of the first region of the closure mechanism in the closed position of said identical lower container. This feature allows stacking the proposed containers. Said notch can be defined by recesses made on the thickness of the material forming the base of the receptacle, or by spaces comprised between ribs made on said base and formed with the same material as the receptacle.

It is also contemplated that there may be arranged between the at least two supporting points of the lid additional supporting points, such as a central supporting point located in the center of the lid, or even a plurality of successive additional supporting points which, together, provide a continuous supporting surface between the two supporting points mentioned above.

The proportions of the first, second, and third segments of the closure mechanism will be configured to allow the complete removal of the first segment of the vertical projection of the lid, thereby allowing the unimpeded removal thereof.

Other features of the invention will become apparent in the following detailed description of an embodiment.

BRIEF DESCRIPTION OF THE DRAWINGS

The foregoing and other advantages and features will be better understood based on the following detailed description of an embodiment with reference to the attached drawings which must be interpreted in an illustrative and non-limiting manner, in which.

DETAILED DESCRIPTION OF AN EMBODIMENT

The attached drawings show illustrative non-limiting embodiments of the present invention.

Figure 1:
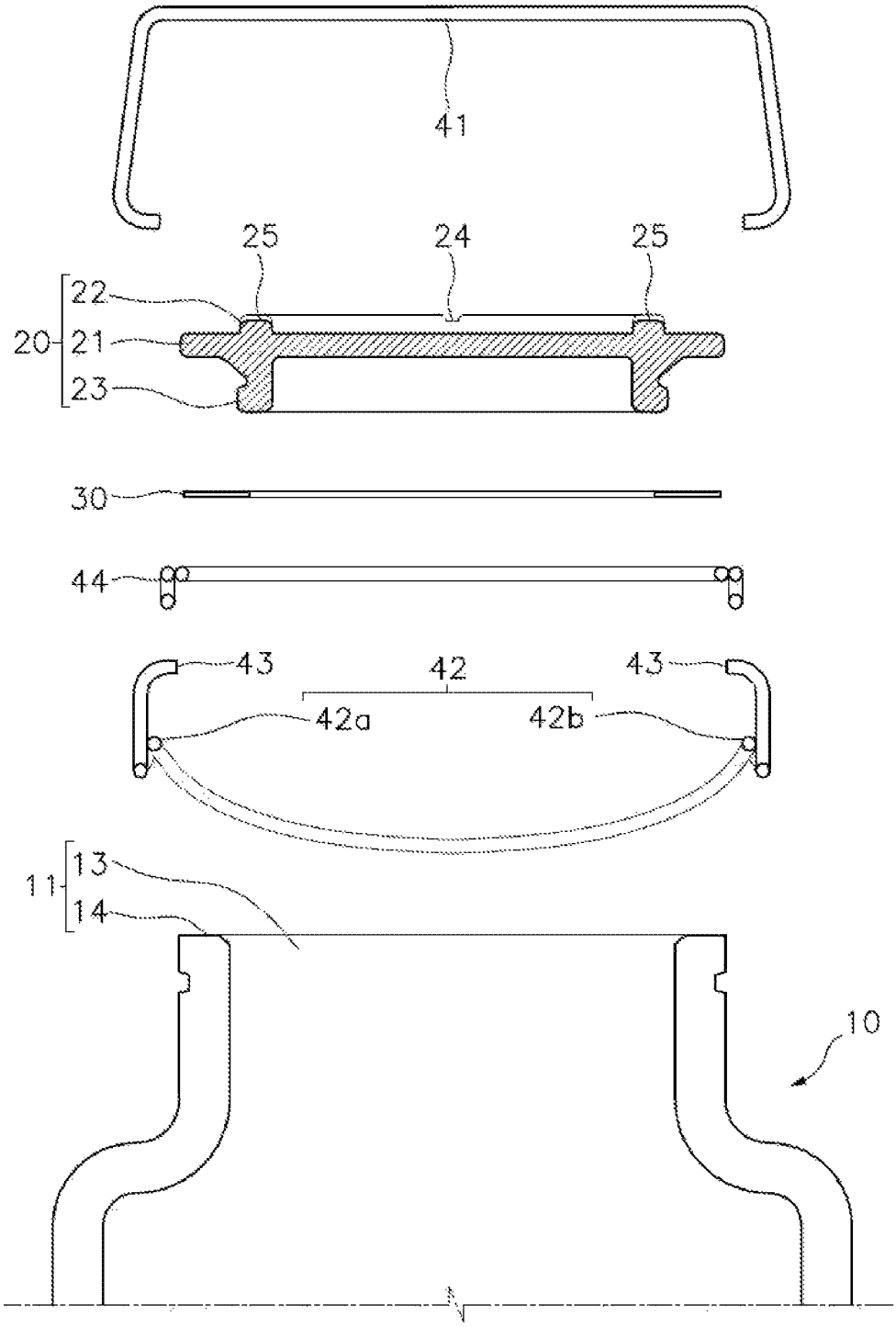
FIG. 1 is an exploded cross-sectional view of a container with a hermetic closure according to a first embodiment of the present invention.
Figure 2:
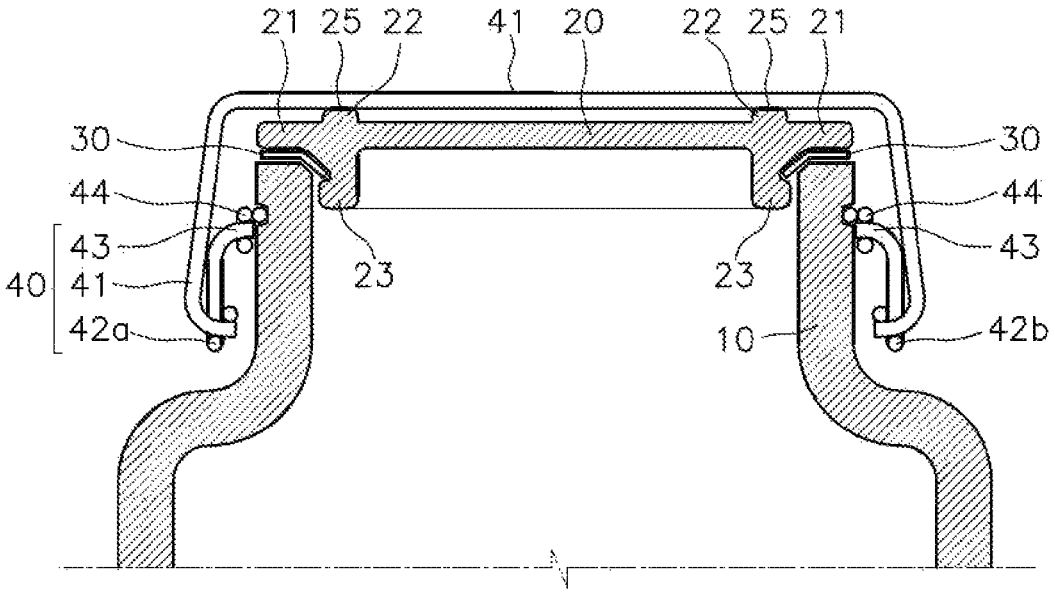
FIG. 2 is a cross-sectional view of the container of FIG. 1 in a closed position.
Figure 3:
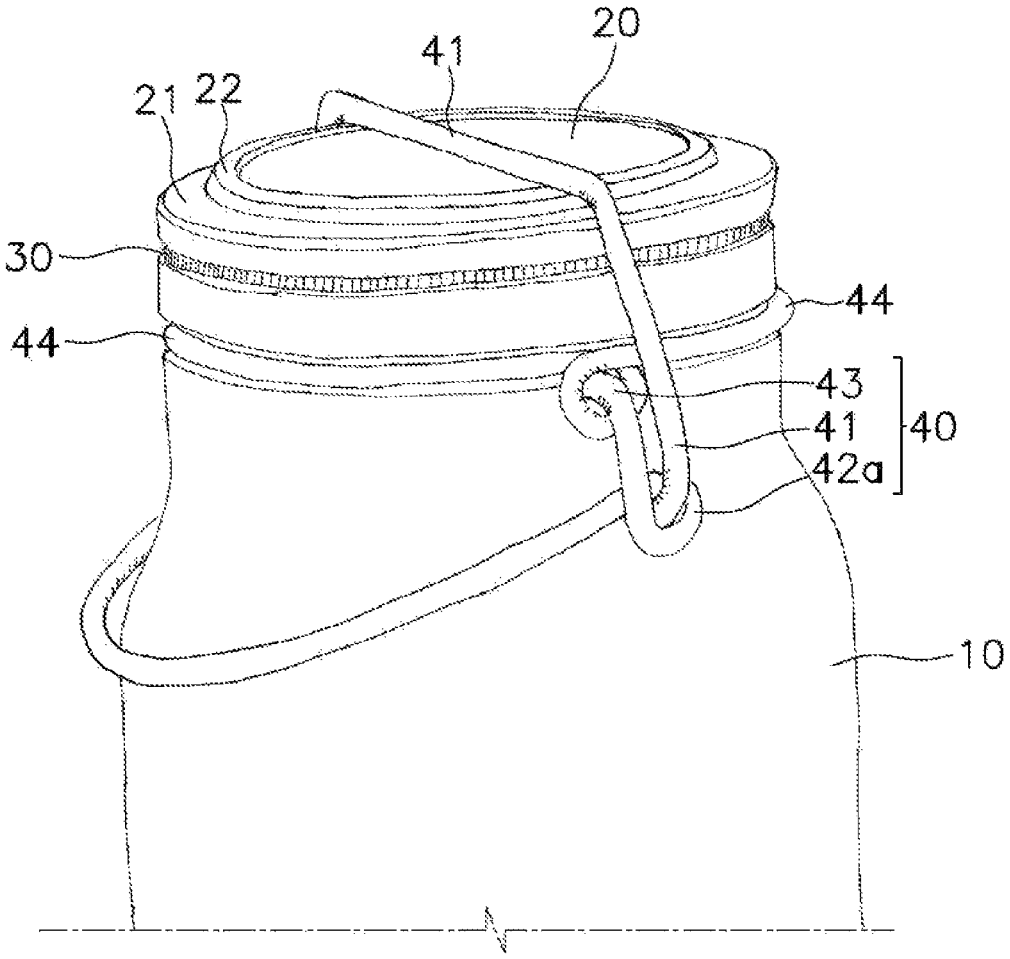
FIG. 3 is a perspective view of the embodiment shown in FIG. 2.

FIGS. 1, 2, and 3 show a container with a hermetic closure comprising a receptacle 10 which, in this example, is proposed to be a glass receptacle 10. Said receptacle 10 is provided with a cylindrical mouth 11 to which there is coupled a lid 20, also preferably made of glass, with a sealing ring 30 interposed to assure a leak-tight sealing between the mouth 11 and the lid 20.

The mouth 11 includes a receptacle opening 13 and an annular mouth surface 14 surrounding said receptacle opening 13.

It will be understood that although the preferred embodiment is made of glass, both the receptacle 10 and the lid 20 can be made of other materials, such as ceramic, for example, or the use of plastic is even optionally contemplated.

The lid 20 is a flat lid formed by a flat circular glass about 5 mm thick, defining a front side oriented upwards and a back side oriented downwards and towards the inside of the receptacle 10. The circular glass has an outer diameter equal to the outer diameter of the mouth 11 of the receptacle 10, such that a perimetral edge of the lid is level with an outer surface of the receptacle 10 adjacent the mouth 11 when superimposed thereon.

From the back side of the circular glass there projects downwardly an annular centering rib 23 in the form of an annular protuberance concentric to the circular glass, formed by the same glass as the rest of the lid 20 and with an outer diameter smaller than the inner diameter of the container opening 13 of the mouth 11 of the receptacle 10, such that said annular centering rib 23 is inserted into the mouth 11 of the receptacle 10 when the lid 20 is in a closed position.

The part of the circular glass comprised between the annular centering rib 23 and the outer perimetral edge of the lid 20 forms an annular flange 21 which, in the closed position, is superimposed on the mouth 11, and the thickness of which is equal to or less than 5 mm.

The front side of the lid 20 incorporates an annular closure rib 22 in the form of an annular protuberance concentric to the rest of the lid 20. Said annular closure rib 22 is formed from the same glass forming the rest of the lid 20.

Preferably, said annular closure rib 22 projects from the front side of the lid 20 in a position vertically coinciding with the position occupied by the annular centering rib 23 located at the back side of the lid 20 and/or with the annular flange 21, i.e., the annular closure rib 22 is completely or partially superimposed on the annular centering rib 23 and/or the annular flange 21.

To keep the sealing ring 30 attached to the lid 20 even when the lid is separated from the receptacle 10, it has been envisaged for the annular centering rib 23 to incorporate an annular perimetral groove in which the sealing ring 30 is partially fitted, thereby being fixed to the lid 20.

Obtaining the described lid 20, incorporating said annular perimetral groove in the annular centering rib 23, requires the lid 20 to be produced with glass pressed in a mold formed by more than two mold parts.

To keep the lid 20 attached to the receptacle 10, there is included a closure mechanism 40 formed by a shaped metal wire which, in the closed position, is partially superimposed on the lid 20, pressing it at two diametrically opposite supporting points 25 of the annular closure rib 22 and against the mouth 11 of the receptacle 10, achieving a hermetic closure.

According to an embodiment shown in FIGS. 1, 2, and 3, the closure mechanism 40 consists of a first shaped wire having an inverted U shape and a flat bottom and a second wire having a U shape and a rounded bottom including symmetrical portions 42*a* and 42*b* in the form of loops in areas close to their ends.

The ends of the second wire are inserted into respective notches arranged on opposite sides of the outer receptacle 10, adjacent to the mouth 11 providing an articulated attachment between the second wire and the receptacle 10. The ends of the first wire are inserted into respective opposite portions 42*a* and 42*b* in the form of loops of the second wire, on opposite sides of the outside of the receptacle 10, providing an articulated attachment between the first wire and the second wire.

Figure 5:
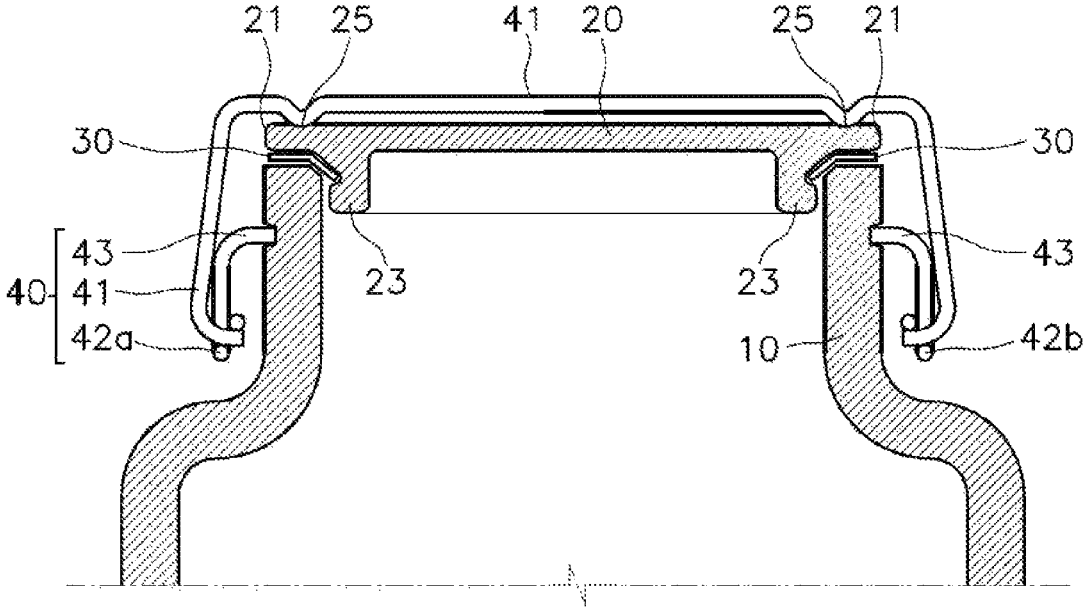
FIG. 5 is a cross sectional view of a container with a hermetic closure according to an alternative embodiment with respect to that shown in FIG. 2.
Figure 6:
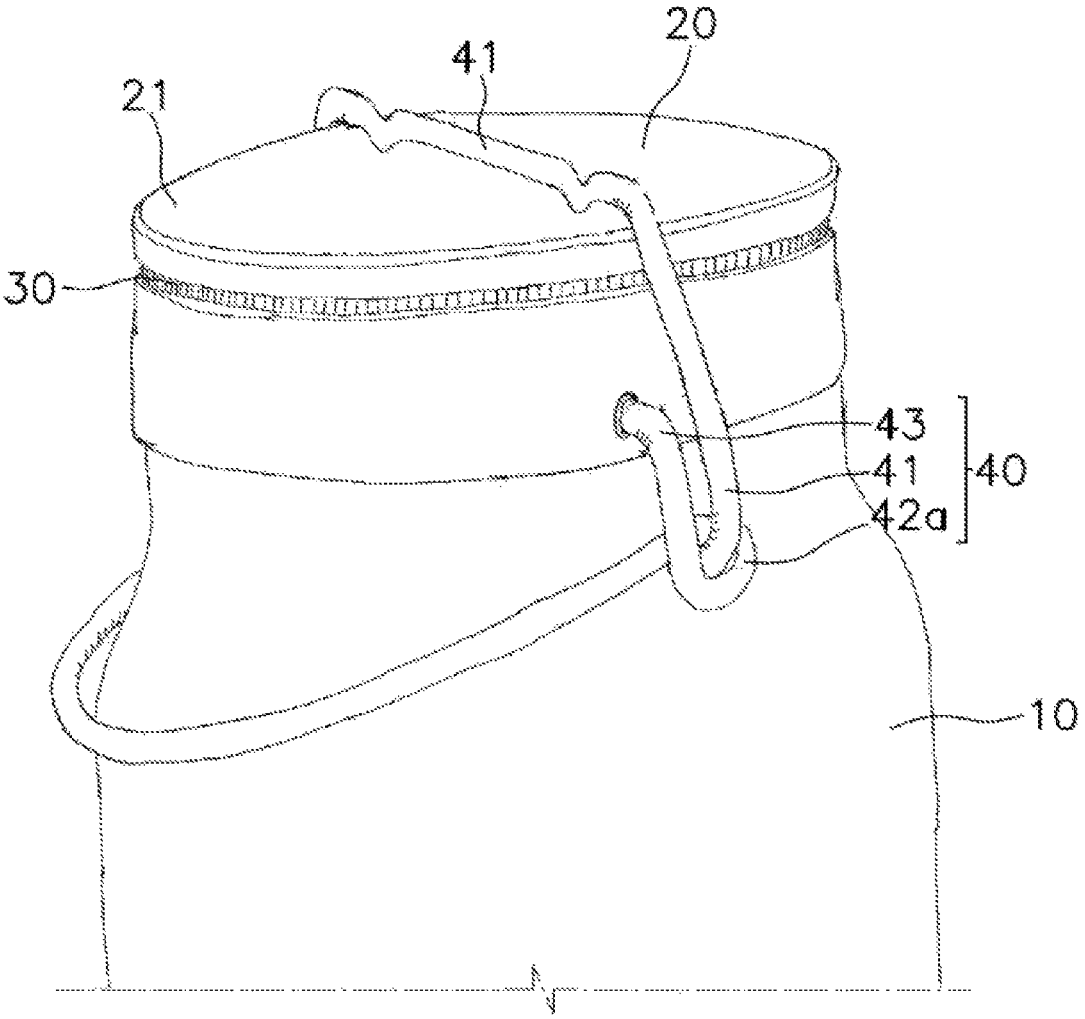
FIG. 6 is a perspective view of the alternative embodiment shown in FIG. 5.

In the present embodiment, said notches are defined in a metallic collar fixed around the receptacle 10, but it is also contemplated for these notches to be notches formed in the actual glass wall of the receptacle 10, as shown in FIGS. 5 and 6.

The first wire is superimposed on the annular closure rib 22 of the lid 20 in the closed position, and the second wire allows, according to its position, moving the symmetrical portions 42*a* and 42*b* in the form of loops to which the first wire is articulated in a vertical direction, with the vertical stress of the first wire on the annular closure rib 22 of the lid 20 being exerted against the mouth 11 of the receptacle 10, assuring hermetic closure thereof.

The first wire constitutes a first region 41 intended for pressing the lid 20 against the receptacle 10, the portions 42*a* and 42*b* of the second wire constitute a second region 42 intended for producing an elastic stress, attracting the first region 41 downwards, and the ends of the second wire articulated with respect to the receptacle 10 form a third region 43 of the closure mechanism 40 intended for connecting the closure mechanism 40 to the receptacle 10, and serving as a supporting point for subjecting the second region to elastic stress.

The portion of the second wire comprised between the symmetrical portions 42*a* and 42*b* in the form of loops is a lever arm which allows a simultaneous and symmetrical actuation of the two symmetrical portions 42*a* and 42*b*, locating the closure mechanism 40 in the closed or open position in which the lid 20 is released, allowing it to be removed from the mouth 11 of the receptacle 10.

Figure 4:
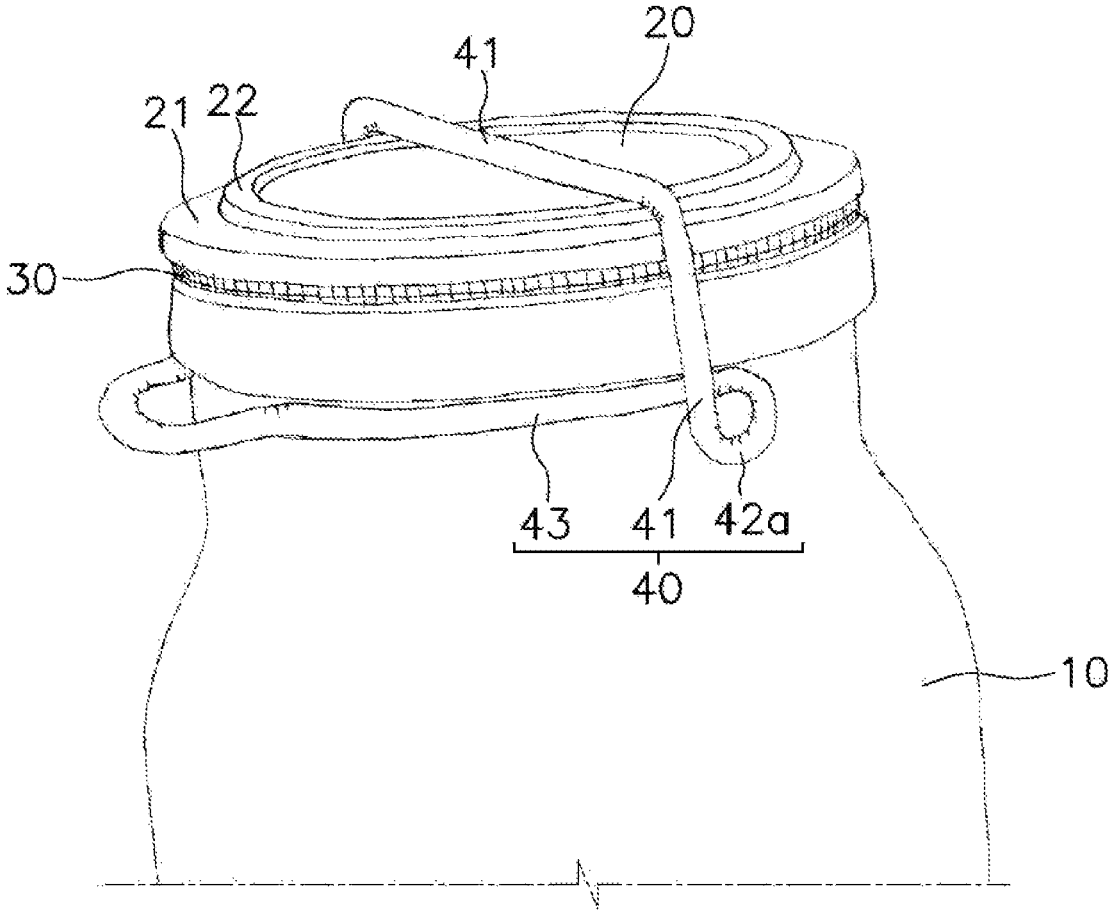
FIG. 4 is a perspective view of a container with a hermetic closure according to a second embodiment of the present invention.

According to another envisaged embodiment shown in FIG. 4, the closure mechanism 40 consists of a single shaped wire having an inverted U shape and a flat bottom.

Said metal wire will have a first region 41 in its central area, intended for being supported on the annular closure rib 22 of the lid 20, a second region defined in two portions 42*a* and 42*b* located in areas close to the ends of the wire, intended for being subjected to certain elastic stress when the closure mechanism 40 is in the closed position, and a third region corresponding to the two ends of the wire, said third region being complementary to an annular groove arranged around the mouth 11 of the receptacle 10, provided for fitting said third region therein, and therefore serving as a supporting point so that the second region can provide elastic stress to the first region which transmits it to the lid 20 through two opposite points of the annular closure rib 22.

Said annular closure rib 22 can be smooth, allowing the first region 41 of the closure mechanism 40 to be supported in any position, or can include notches 24 provided so that the first region 41 of the metal wire can be fitted therein in pre-established positions.

Figure 7:
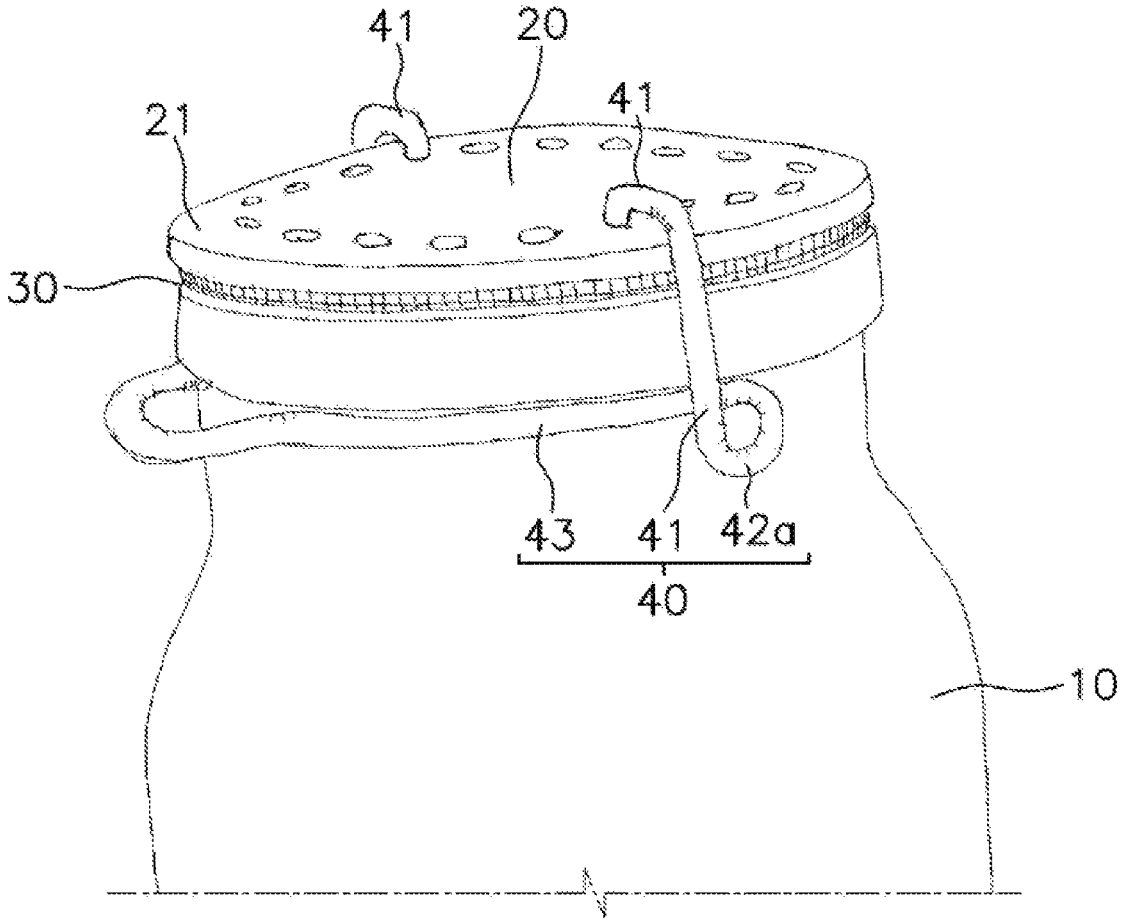
FIG. 7 is a perspective view of a container with a hermetic closure according to another alternative embodiment with respect to that shown in FIG. 4.

An alternative version of this same solution is shown in FIG. 7 and proposes for the two ends of the single shaped metal wire forming the closure mechanism 40 to be located on the lid 20, jointly constituting the first region 41. Each end of the single shaped metal wire is bent downwards in a sinuous shape and presses the lid at a supporting point 25. Said supporting points 25 can be located in pits or recesses, for example cylindrical pits, of the lid 20.

According to an alternative embodiment, for example, the one shown in FIGS. 5 and 6, the supporting points 25 of the lid 20 are rounded pits and the first region 41 of the closure mechanism 40 includes bends the ends of which coincide with and are fitted to the supporting points 25. Ends of the third region 43 of the closure mechanism 40 are inserted into pits provided on the sides of the receptacle providing an articulated attachment.

It will be understood that the different parts forming the invention described in one embodiment can be freely combined with the parts described in other different embodiments even though said combination has not been explicitly described, provided that the combination does not entail any drawback.

What is claimed is:

1. A container with a hermetic closure, the container including:

a receptacle provided with a mouth including a receptacle opening and an annular mouth surface surrounding said receptacle opening;

a lid having a front side and a back side, the back side intended for being oriented towards the inside of the receptacle, said lid including an annular perimetral flange which, in a closed position, is superimposed on the annular mouth surface of the receptacle, the front side including a protruding annular closure rib and the back side including an annular centering rib of a smaller diameter than the mouth of the receptacle which, when the lid is in the closed position the annular centering rib is inserted into the mouth;

a sealing ring fitted in an annular perimetral groove of the annular centering rib held between the annular mouth surface of the receptacle and the lid;

a closure mechanism unitarily movable between a closed position, in which the closure mechanism holds the lid against the annular mouth surface of the receptacle, and an open position, in which the closure mechanism releases the lid allowing the opening thereof, the closure mechanism being formed by a shaped metal wire defining:

a first region configured for being superimposed, when in the closed position, on the front side of the lid;

a second region formed by two symmetrical opposite portions arranged on opposite sides of the mouth of the receptacle, each symmetrical opposite portion being connected to a different end of the first region and configured for being under elastic stress when in the closed position, attracting the first region to the mouth of the receptacle;

at least a third region configured for being coupled, when in the closed position, to the receptacle in a position adjacent to the mouth of the receptacle and connected to the symmetrical opposite portions of the second region (42);

wherein the annular closure rib is completely or partially superimposed on the annular centering rib, said annular closure rib including at least two opposite supporting points in an area coinciding with or adjacent to the annular flange, and in that the first region of the closure mechanism is configured for being supported, in the closed position, on said at least two opposite supporting points.

2. The container according to claim 1, wherein the first region of the closure mechanism is shaped defining a bend coincident with said at least two opposite supporting points when the closure mechanism is in the closed position.

3. The container according to claim 1, wherein the annular closure rib has a smooth surface with a plurality of supporting points for receiving the first region of the closure mechanism.

4. The container according to claim 1, wherein the annular closure rib includes notches at certain intervals, each notch corresponding to a supporting point for receiving the first region of the closure mechanism in said notches.

5. The container according to claim 4, wherein the annular closure rib has, between two contiguous notches, an inclined supporting surface defining a slope towards said notch for leading the first region of the closure mechanism to the closest notch.

6. The container according to claim 4, wherein the notches have a depth equal to or greater than the thickness of the metal wire.

7. The container according to claim 1, wherein the first region is formed by a first metal wire and the two symmetrical opposite portions forming the second region are formed by a second metal wire independent of the first metal wire, each of two opposite ends of the first metal wire being attached in an articulated manner to the second metal wire, and the second metal wire being attached to the receptacle by two opposite articulated attachments defined by the third region of the closure mechanism at opposite sides of the mouth.

8. The container according to claim 7, wherein the third region of the closure mechanism is defined by two ends of the second metal wire inserted into respective housings of the receptacle.

9. The container according to claim 8, wherein the housings are housings defined in a wall of the receptacle.

10. The container according to claim 8, wherein the housings are housings defined in a fixed collar around the receptacle in a position adjacent to the mouth.

11. The container according to claim 7, wherein a segment of the second metal wire connecting the two symmetrical opposite portions of the second region forms a lever arm which simultaneously actuates both symmetrical opposite portions for arranging the closure mechanism in the open position or closed position.

12. The container according to claim 1, wherein the first region, the second region, and the third region are formed with one and the same metal wire, the third region being complementary to an annular notch defined around the mouth of the receptacle.

13. The container according to claim 12, wherein the second region is shaped in the form of a spring loop.

14. The container according to claim 1, wherein said annular flange has a thickness equal to or less than 5 mm.

15. The container according to claim 1, wherein a central portion of the lid which is devoid of an annular centering rib has a thickness equal to or less than 5 mm.

16. The container according to claim 1, wherein the sealing ring is made of a molded material with a thickness equal to or less than 2.5 mm.

17. The container according to claim 1, wherein the receptacle and/or the lid are made of glass or ceramic.

18. The container according to claim 1, wherein the receptacle and/or the lid are made of plastic.

19. The container according to claim 1, wherein the lid is made of glass and has a flat circular shape with the annular closure rib and the annular centering rib protruding on opposed sides of the flat circular shape, the annular closure rib and the annular centering rib being concentric to the flat circular shape.

* * * * *